United States Patent [19]

Hazard

[11] Patent Number: 4,625,898

[45] Date of Patent: Dec. 2, 1986

[54] DISPENSING CLOSURE EMPLOYING LIVING HINGE WITH CAMS TO MOMENTARILY DEFORM HINGE AND RECESSES TO ACCEPT CAMS

[75] Inventor: Robert E. Hazard, North Kingstown, R.I.

[73] Assignee: Polytop Corporation, Slatersville, R.I.

[21] Appl. No.: 649,290

[22] Filed: Sep. 11, 1984

[51] Int. Cl.[4] ..... B65D 47/00

[52] U.S. Cl. ..... 222/517; 222/546; 215/235

[58] Field of Search ..... 222/498, 517, 543, 546, 222/562, 545; 215/235, 238, 244, 306; 220/335, 339, 375, 254

[56] References Cited

U.S. PATENT DOCUMENTS

| | | | |
|---|---|---|---|
| 4,158,902 | 6/1979 | Chernack et al. | 16/150 |
| 4,220,248 | 9/1980 | Wilson et al. | 222/517 |
| 4,377,247 | 3/1983 | Hazard et al. | 222/517 |

*Primary Examiner*—Joseph J. Rolla
*Assistant Examiner*—Kenneth Noland
*Attorney, Agent, or Firm*—Martin P. Hoffman; Karen M. Gerken; Mitchell B. Wasson

[57] ABSTRACT

An integrally molded, unitary, plastic dispensing closure comprising a body, a lid, and a "living" hinge that joins the lid to the body. Cams and cooperating wall surfaces in the vicinity of the hinge provide forces that temporarily deform the hinge, within its plastic limits, and facilitate the movement of the lid to either an opened, or a closed, position. In one embodiment, recesses are formed at the rear of the closure body to accommodate the cams when the closure is in its closed position. In another embodiment, recesses are formed in the skirt of the lid to accept upwardly extending posts, and a cavity is defined in the upper surface of the closure body to accept cams, or lugs, depending below the lid. An efficient, aesthetically pleasing, low profile dispensing closure is achieved in each instance.

6 Claims, 24 Drawing Figures

DISPENSING CLOSURE EMPLOYING LIVING HINGE WITH CAMS TO MOMENTARILY DEFORM HINGE AND RECESSES TO ACCEPT CAMS

FIELD OF THE INVENTION

The invention relates generally to dispensing closures having lids that are joined to the closure body by an integrally formed hinge, and more particularly to camming surfaces that cooperate with the "living" hinge to temporarily deform same and urge the lid between an opened and a closed position.

BACKGROUND OF THE INVENTION

Molded plastic dispensing closures, that can be integrally molded, have met with widespread commercial acceptance for dispensing products too diverse to enumerate and/or categorize. Known dispensing closures usually include a closure body that is secured to the neck of the container holding the product to be dispensed or discharged, and a lid that can be pivoted between an open, or discharging position, and a closed position. A "living" hinge is frequently integrally molded with the lid and the closure body from a polymeric plastic, and the "living" hinge enables the lid to be pivoted relative to the closure for the life expectancy of the closure.

While the dispensing closures described supra function satisfactorily under most conditions, the "living" hinges occasionally fail structurally or do not function satisfactorily. Such problems with the living hinges, which are but a few thousandths of an inch in thickness, have caused the closure industry to look for more effective ways of stressing, and/or operating, the "living" hinges.

Other problems have been encountered with known dispensing closures utilizing "living" hinges. In many instances, the hinge is formed as a bell-crank with one end secured to the rear surface of the closure body and the other end secured to the central area of the lid. A notch is cut out of the lid to allow the hinge to flex properly. When the lid is pivoted into its closed position, one leg of the bell-crank fits within the notch, leaving a small clearance therebetween. The small clearance, while necessary for the successful operation of the "living" hinge, provides a discontinuous upper surface for the lid. Dirt, dust, residue of the product being dispensed, and other foreign materials can accumulate in the clearance and create an unsightly appearance. Since the dispensing closures are frequently used on containers for hair care products, nail care products, foodstuffs, and other products which require an aesthetically pleasing, and almost sterile appearance, the discontinuities in the surface of the lid have proven to be a consistently negative factor.

Furthermore, in some instances, the lid secured by the "living" hinge to the closure body has sagged inwardly. The sag in the lid is unsightly, and detracts from the visual appearance of the dispensing cap; also, the sag provides a place for dirt and dust to accumulate during the shelf-life of the container upon which the dispensing closure is seated.

In order to properly stress the "living" hinge of known closures as the lid is pivoted between its opened and closed positions, diverse camming mechanisms have been utilized. For example, as shown in U.S. Pat. No. 4,220,248, granted Sept. 2, 1980 to W. S. Wilson and R. E. Hazard, upstanding resilient posts (50) project upwardly from the upper surface of the closure body and coact with cams, or camming surfaces (52), defined at the lower edge of the skirt of the lid. The cams contact and deform the posts during movement of the lid, and enhance the successful operation of the closure. A similar camming action is achieved by cooperating, dissimilarly oriented posts or tabs situated on the top surface of the closure body and the underside of the lid, as shown in U.S. Pat. No. 4,158,902, granted in June 1979, to Milton Chernack et al.

Employing upstanding posts, or tabs, for coaction with camming surfaces defined on the lid successfully assisted the operation of the "living" hinge utilized in the dispensing closures. However, posts and tabs proved to be difficult to mold accurately, and such upstanding projections frequently interfered with the high speed capping machines used to secure the dispensing closures atop containers. Also, the posts and tabs presented surfaces about which dirt, dust, product residue, and the like could easily accumulate. Consequently, dispensing closure of this type have met with limited commercial success and consumer acceptance.

Several other dispensing closures have been designed to provide a camming action that will enhance the operation of the "living" hinge employed within such closures. One known dispensing closure of particular interest is shown in U.S. Pat. No. 4,377,247, granted Mar. 22, 1983, to Robert E. Hazard and Woodrow S. Wilson. This patent is assigned to Polytop Corporation of Slatersville, R. I. the corporate assignee of the present application.

The dispensing closure depicted in the Hazard et al patent provides a camming action by virtue of the engagement of lower edges (52) on the skirt of the lid engaging the flat wall (22) formed on the upper surface of the closure body, and in the vicinity of the hinge (16). The closure body is sealed by a sloping top that includes the flat wall, and a holder (32) is formed to locate the "living" hinge so that the lid and closure body are joined together. While this dispensing closure has met with commercial acceptance, has good visual appeal, and has functioned satisfactorily on a variety of containers, such closure utilizes a relatively long skirt on the lid and thus is difficult to mold and to remove from the mold. Consequently, a parting line is visible on the skirt of the closure; also, such closure requires costly tools and dies in order to manufacture same on a commercially feasible basis.

SUMMARY OF THE INVENTION

Thus, with the deficiencies of conventional dispensing closures utilizing "living" hinges clearly in mind, the instant invention contemplates a unitary dispensing closure that is easy to mold, presents an aesthetically pleasing appearance with a minimum of surfaces that might capture dirt, dust, product residue and the like, and yet is compatible with high speed automated equipment that screws the closure onto the containers.

Furthermore, the instant dispensing closure provides integrally formed cams that enhance the operation of the "living" hinge as it temporarily deforms, within its elastic limits, to urge the lid toward its closed or opened positions. The cams depend below the skirt of the lid; in the preferred embodiment of the invention, the cams assume the form of lugs that rest within recesses at the rear of the closure body, while in the alternative embodiment, the cams assume the forms of posts that rest within recesses defined in the skirt of the lid for the closure body. In both embodiments, the introduction of the cams into the recesses contributes to a low profile closure having a reduced overall height which contributes to its aesthetic appeal.

The instant invention sets forth a dispensing closure that employs a lid with an unbroken, continuous, planar upper surface and a shallow depending skirt. The unbroken upper surface is easily kept clean and is sturdy enough to resist the inward sagging or bowing experienced with certain of the known dispensing closures currently in use on diverse products. Also, the shallow skirt is formed without a parting line or other visual blemish.

Both embodiments of the instant dispensing closure position the cams and cooperating wall surfaces in proximity to the "living" hinge and effectively, and efficiently, work in concert therewith. The "living" hinge is properly positioned by employing a holder for this purpose. The hinge, cams and cooperation wall surfaces thus insure that the closure only assumes a closed position or an opened position, and does not come to rest in an intermediate position which would interfer with the dispensing function.

Yet additionally, the instant invention will suggest diverse other advantages to the skilled artisan when the ensuing specification is construed in harmony with the appended drawings.

DESCRIPTION OF PRIOR ART DEVICES

Figure 1:
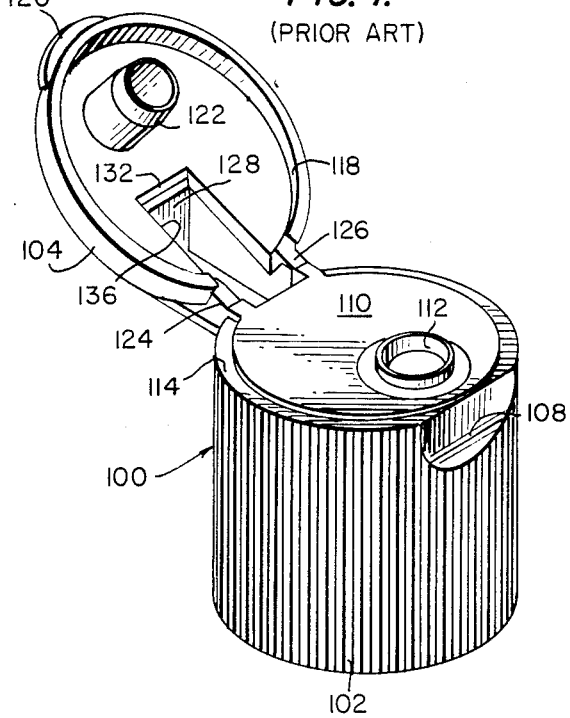
FIG. 1. (PRIOR ART)
FIG. 1 is a perspective view taken from the front of a first conventional dispensing closure, such closure being shown in its opened position.

FIGS. 1–4 depict a first conventional dispensing closure manufactured and sold by the Seaquist Closure Corp. of Cary, Ill. to numerous packers of sundry products, including shampoos, hand lotions, food products, etc. Such closure is indicated generally by reference numeral 100, and comprises a closure body 102, a lid 104, and a "living" hinge 106 that joins the lid to the body. The body, lid, hinge and other components are integrally molded of a durable yet resilient plastic to form a one-piece closure; polypropylene is an exemplary plastic.

Closure body 102 is substantially cylindrical in shape, and is internally threaded (not shown) so that the closure body can be secured to the neck of a container (not shown) which contains the product to be dispensed. An indentation 108 is formed in the front face of the closure, and a top surface 110 extends across the upper end of the closure body. A discharge opening 112 extends through surface 110, and an annular seating surface 114 extends around the perimeter of surface 110.

Lid 104 comprises a planar top 116 and an annular skirt 118. A tab 120 projects forwardly from skirt 118 on lid 104, and a sealing plug 122 depends below the plane of the lid. The plug 122 fits into discharge opening 112 to seal the contents of the container to which the closure has been secured when the lid 104 is pivoted toward its closed position (shown in FIGS. 2–3).

Figure 4:
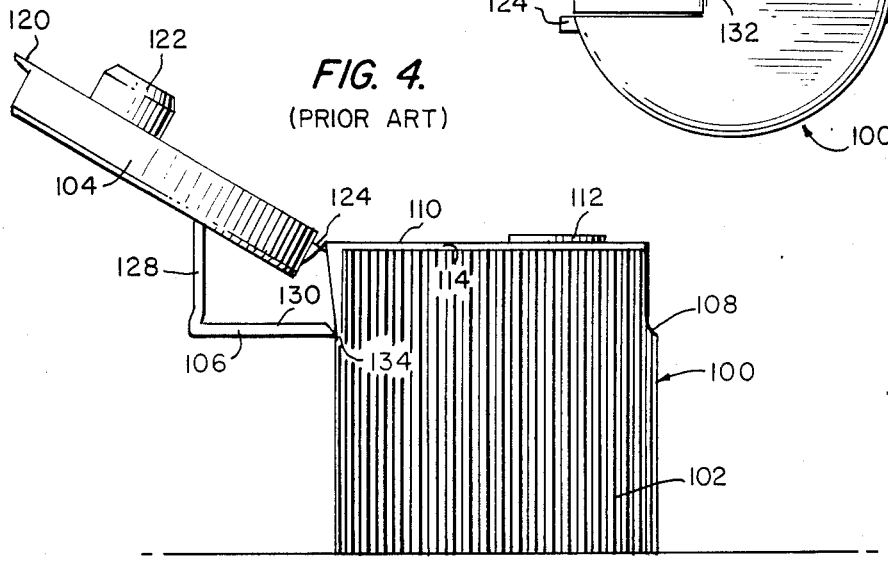
FIG. 4. (PRIOR ART)
FIG. 4 is a side elevational view of the conventional dispensing closure of FIGS. 1–3, such closure being shown in its opened position.

Hinge 106 is but a few thousandths of an inch in thickness, as suggested in FIG. 4. A first thin strap 124 is formed adjacent one edge of hinge 106, and a second thin strap 126 is formed adjacent the other edge of hinge 106. The straps are reduced in thickness along a common line which serves as a pivot when the lid is pivoted relative to the closure body.

Hinge 106 is shaped as a bell-crank lever, and comprises a first lever arm 128 and a second lever arm 130. A thin pivot line 132 joins lever arm 128 to the planar top 116 of lid 104, and a similar thin pivot line 134 joins the second lever arm 130 to the rear surface of closure body 104 below surface 110. The hinge 106 is temporarily deformed as the lid 104 is pivoted, by manual pressure, from the opened position (shown in FIGS. 1 and 4) to the closed position (of FIGS. 2 and 3). The hinge provides a biasing force that snaps the lid between these two positions, and may even provide an audible "click" as the lid passes from one stable condition to the other. The sealing operation is completed by pressing the lid downwardly to force plug 122 securely into opening 112 and to seat the lower edge of skirt 118 upon seating surface 114. The opening process is initiated by lifting upwardly upon tab 120 on the lid 104 as the tab projects above indentation 108.

Figure 2:
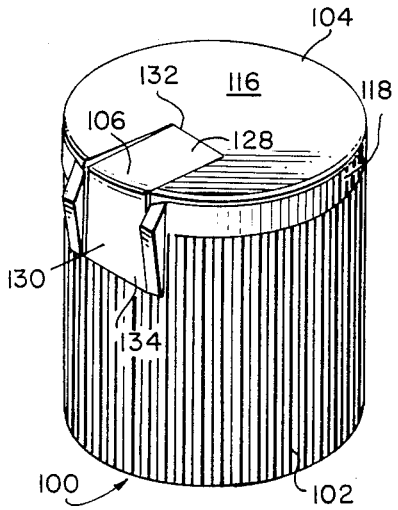
FIG. 2. (PRIOR ART)
FIG. 2 is a perspective view of the rear of the conventional dispensing closure of FIG. 1, such closure being shown in its closed position.
Figure 3:
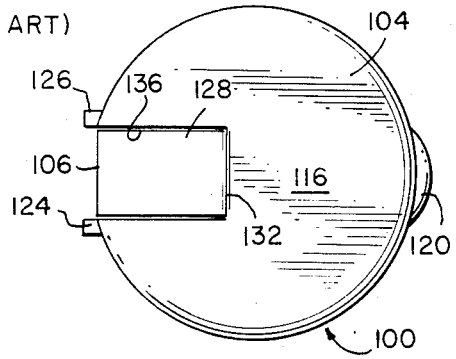
FIG. 3. (PRIOR ART)
FIG. 3 is a top plan view of the conventional dispensing closure of FIGS. 1–2.

A U-shaped notch 136 (visible in FIG. 1) extends clearly through the planar top 116 and skirt 118 of the lid to accommodate the lever arms 128, 130 of hinge 106 when the lid is closed. The notch 136 is somewhat larger than the hinge, so that the lid and hinge may move more relative to one another as the lid is pivoted between its closed and opened positions. Notch 136 thus provides clearance spaces between the sides of the hinges and the lid, as shown in FIGS. 2 and 3.

These clearance spaces, however, provide sites for collecting dirt, dust, and residue of the product being dispensed. Also, the planar top 116 of the lid 104 frequently bows, or dishes, inwardly, and provides another site for the accumulation of dirt, dust, etc. These deficiencies detract from the aesthetic appeal of the dispensing closure, which is a significant consideration in a highly competitive, consumer oriented market. Also, these deficiencies tend to shorten the shelf-life of the products contained therein, for dirty or dusty closures suggest that the contents of the container may be damaged, tainted, or less than fully effective for their intended purpose.

Figure 5:
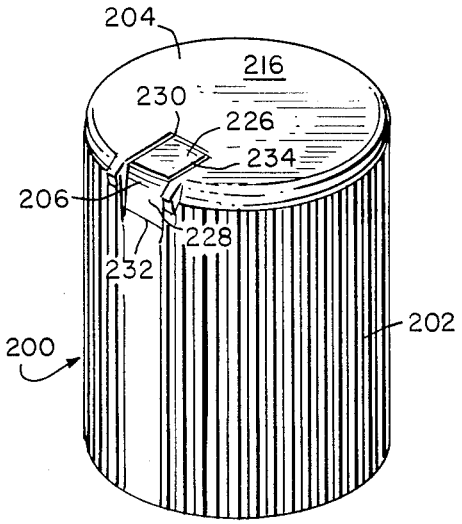
FIG. 5. (PRIOR ART)
FIG. 5 is a perspective view taken from the rear of a second conventional dispensing closure, such closure being shown in its closed position.
Figure 6:
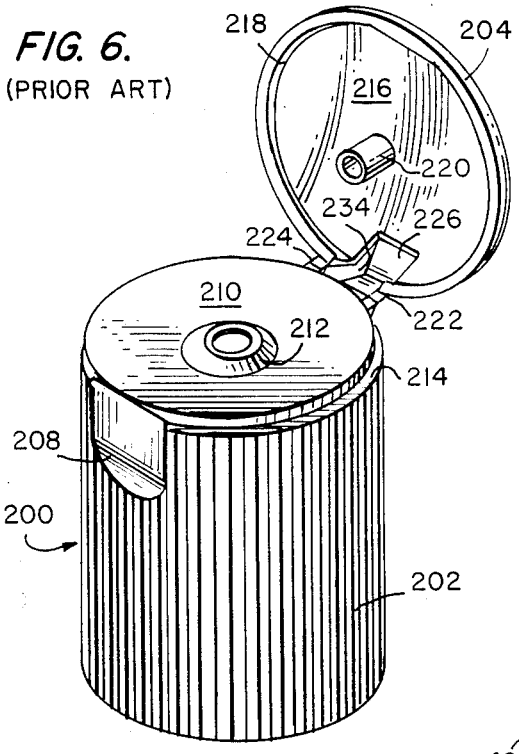
FIG. 6. (PRIOR ART)
FIG. 6 is a perspective view of the front of the conventional dispensing closure of FIG. 5, such closure being shown in its opened position.

FIGS. 5–6 depict a second conventional dispensing closure manufactured and sold by the Seaquist Closure Corp. of Cary, Ill. Such closure is indicated generally by reference numeral 200, and comprises a closure body 202, a lid 204, and a "living" hinge 206 that joins the lid to the body. The body, lid, hinge and other components are integrally molded of a durable, yet resilient plastic to form a one-piece closure.

Closure body 202 is substantially cylindrical in shape, and is internally threaded (not shown) so that the closure body can be secured to the neck of the container (not shown) which contains the product to be dispensed. An indentation 208 is formed in the front face of the closure, and a top surface 210 extends across the upper end of the closure body. A discharge opening 212, extends through surface 210, and an annular seating surface 214 extends around the perimeter of surface 210.

Lid 204 comprises a planar top 216 and a shallow, annular skirt 218. A sealing plug 220 depends below the plane of the lid. The plug 220 fits into discharge opening 212 to seal the contents of the container to which the closure has been secured when the lid is pivoted to its closed position, as shown in FIG. 5.

Hinge 206 is but a few thousandths of an inch in thickness. A first thin strap 222 is formed adjacent one edge of hinge 206, and a second thin strap 224 is formed adjacent the other edge of hinge 206. The straps are reduced in thickness along a common line which serves as a pivot when the lid is pivoted relative to the closure body.

Hinge 206 is shaped as a bell-crank lever, and comprises a first lever arm 226 and a second lever arm 228. A thin pivot line 230 joins lever arm 226 to the planar top 216 of lid 204, and a similar thin pivot line 232 joins the second lever arm 228 to the rear surface of closure body 204 below surface 210. The hinge 206 is temporarily deformed as the lid 204 is pivoted from the opened position (FIG. 6) to the closed position (FIG. 5), and vice versa.

A U-shaped notch 234 (visible in FIG. 6) is formed clearly through the planar top 216 and skirt 218 of the lid to accommodate the lever arms 226, 228 when the lid is closed. The notch 234 is somewhat larger than the hinge 206, so that the lid and hinge may move relative to one another as the lid is pivoted between its closed and opened positions. Notch 234 thus provides clearance spaces between the sides of the hinges and the lid, as shown in FIG. 6.

These clearance spaces, in the same manner as the clearance spaces discussed with regard to dispensing closure 100 shown in FIGS. 1–4, provide sites for collecting dirt, dust, and residue, and commercial appeal of the closure 200 is thereby diminished.

FIGS. 7–10 depict a third conventional dispensing closure. Such closure is manufactured and sold under the mark POLYCAM by the Polytop Corporation of Slatersville, R.I., U.S.A., the assignee of the present application. The closure is described briefly in the following paragraphs, but is described in detail in U.S. Pat. No. 4,377,247, granted Mar. 22, 1983 to Robert E. Hazard and Woodrow S. Wilson.

Such closure is indicated generally by reference numeral 300, and comprises a closure body 302, a lid 304, and a "living" hinge 306 that joins the lid to the body. The body, lid, hinge and other components are integrally molded of a durable, yet resilient plastic, to form a one-piece closure.

Closure body 302 is substantially cylindrical in shape, and has internal threads 308 so that the closure body can be secured to the neck of a container (not shown) which contains the product to be dispensed. Vertical ribs or ridges may be formed on the exterior of the closure body to facilitate the application of the closure body to the container. A top surface 310, which slopes downwardly toward the front of the closure, extends across the upper end of the closure body. A discharge opening 312 extends through surface 310, and an annular seating surface 314 extends around the perimeter of surface 310, but is spaced a short distance therebelow.

Lid 304 comprises a planar top 316 and an annular skirt 318. An indentation 320 is formed on the front surface of the skirt, and a sealing plug 322 fits into discharge opening 312 to seal the contents of the container to which the container has been secured when the lid 304 is pivoted into its closed position.

Figure 8:
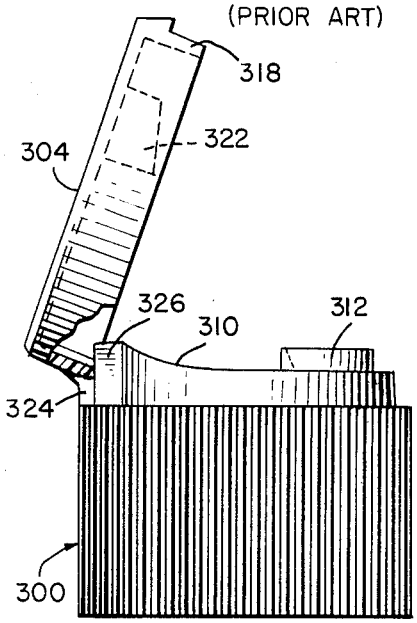
FIG. 8. (PRIOR ART)
FIG. 8 is a side elevational view of the closure of FIG. 7, such closure being shown in its opened position.
Figure 9:
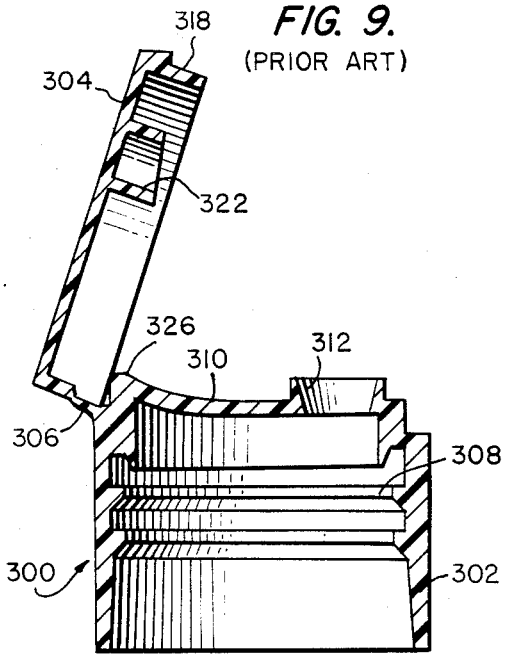
FIG. 9. (PRIOR ART)
FIG. 9 is a vertical cross-sectional view of the dispensing closure of FIGS. 7–8, such view being taken along a plane passing through the interior of the closure with the closure being shown in its opened position.
Figure 10:
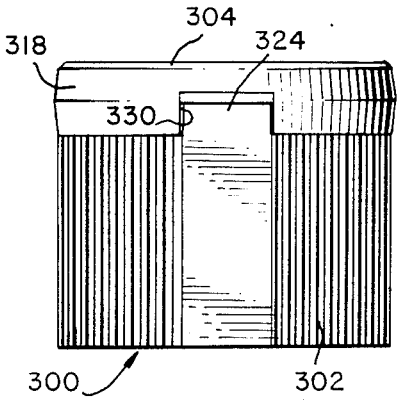
FIG. 10. (PRIOR ART)
FIG. 10 is a rear elevational view of the dispensing closure of FIGS. 7–9, such view showing the closure in its closed position.
Figure 11:
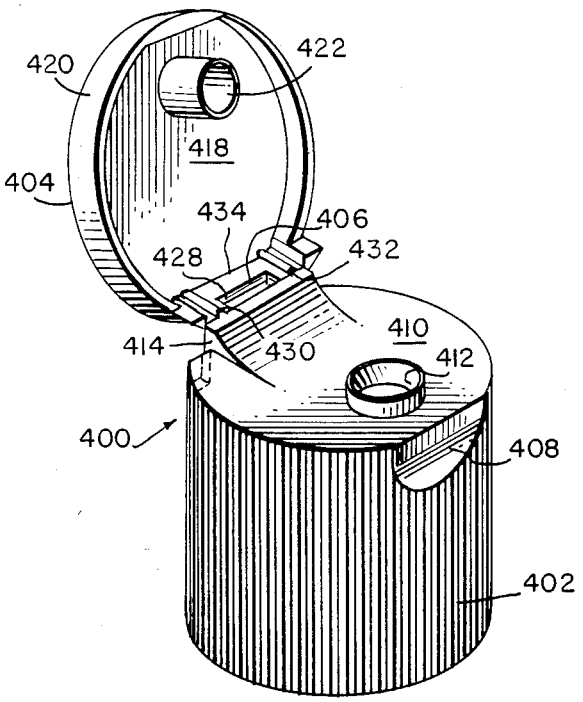
FIG. 11 is a perspective view taken from the front of the preferred embodiment of a unique dispensing closure constructed in accordance with the principles of this invention, such closure being shown in its opened position.
Figure 12:
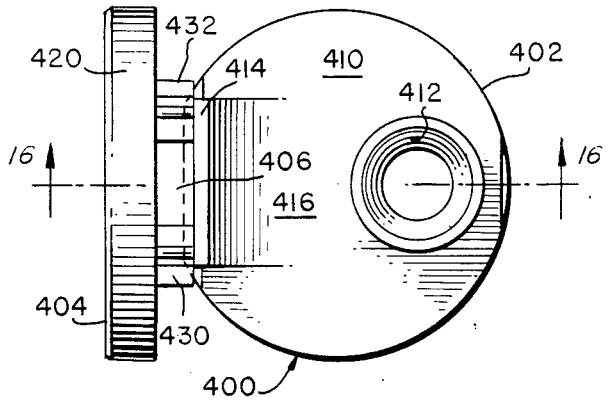
FIG. 12 is a top plan view of the closure of FIG. 11.

Hinge 306 is but a few thousandths of an inch in thickness, and is thinner than the skirt 318 on lid 316, as shown in FIG. 9. A reinforced holder 324 is formed adjacent to the thickened, upstanding wall 326 that demarcates the rear, and higher, end of surface 310, as shown in FIG. 8. One end of the hinge is joined at pivot line 328 to the skirt 318 of lid 304, and the other end is joined to holder 324. A notch 330, which extends cleanly through the skirt 318 of the lid, accommodates the hinge when the lid is pivoted into its closed position, as shown in FIG. 10. The planar top 316 of the lid remains continuous and thus enhances its aesthetic appeal by avoiding dust, dirt and product residue build-ups.

In order to enhance the successful operation of the "living" hinge, and to increase its life expectancy, the lower edges of skirt 318 function as camming surfaces which engage wall 326 to temporarily deform hinge 306 as the cap is pivoted between its opened and closed positions. This relationship is shown in FIG. 8, wherein a fragment of the skirt 318 is broken away to reveal the engagement of the skirt with the wall 326.

DETAILED DESCRIPTION OF THE PREFERRED EMBODIMENT OF THE INVENTION

Now that three conventional closures presently available in the market place have been described generally to present an overview of the most relevant prior art, the specification proceeds to describe, in greater detail, two embodiments of a unique dispensing closure constructed in accordance with the principles of this invention. The preferred embodiment of the dispensing closure is shown in FIGS. 11–18, and the alternative embodiment of the dispensing closure is shown in FIGS. 19–24.

Figure 14:
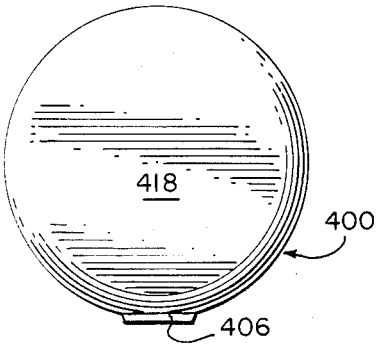
FIG. 14 is a top plan view of the closure of FIGS. 11–13 with the closure being shown in its closed position.

The preferred embodiment of the unique dispensing closure is manufactured and sold by the Polytop Corporation, the assignee of U.S. Pat. No. 4,377,247 discussed above. Such closure is identified generally by reference numeral 400, and comprises a closure body 402, a lid 404, and a "living" hinge 406 that joins the lid to the body. The body, lid, hinge and other components are integrally molded of a durable, yet resilient plastic, to form a one-piece closure. Closure body 402 is substantially cylindrical in shape, and has internal threads 407 so that the closure body can be secured to the neck of a container (not shown) which contains the produce to be dispensed. An indentation 408 is formed in the front face of the closure, and a top surface 410 extends across the upper end of the closure body. A discharge opening 412 extends through surface 410. A thickened wall 414 projects upwardly above surface 410, and a wall 416 slopes downwardly from the top of wall 414 to blend into surface 410, as shown in FIG. 14.

Figure 17:
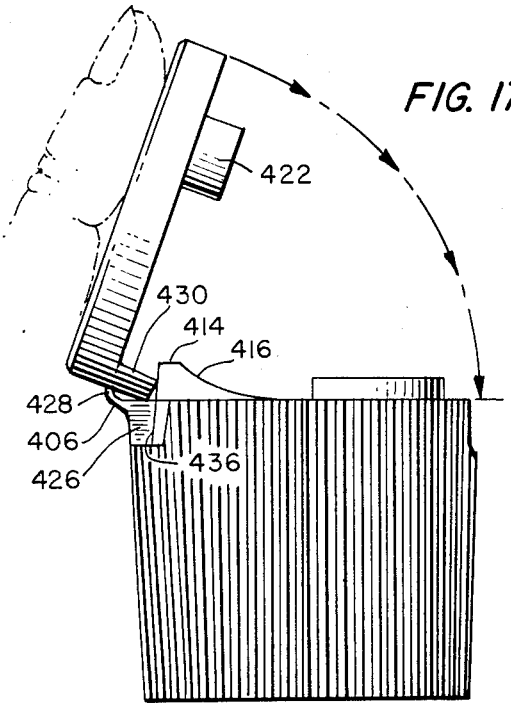
FIG. 17 is a side elevational view of the closure of FIGS. 11–16, such view showing the closure being pivoted toward its closed position.

Lid 404 comprises a continuous planar top 418 and a shallow, annular skirt 420. A sealing plug 422 depends below the skirt. The plug 422 fits into opening 412 to seal the contents of the container to which the closure has been secured when the lid is pivoted toward its closed position, as shown in FIG. 17.

Figure 16:
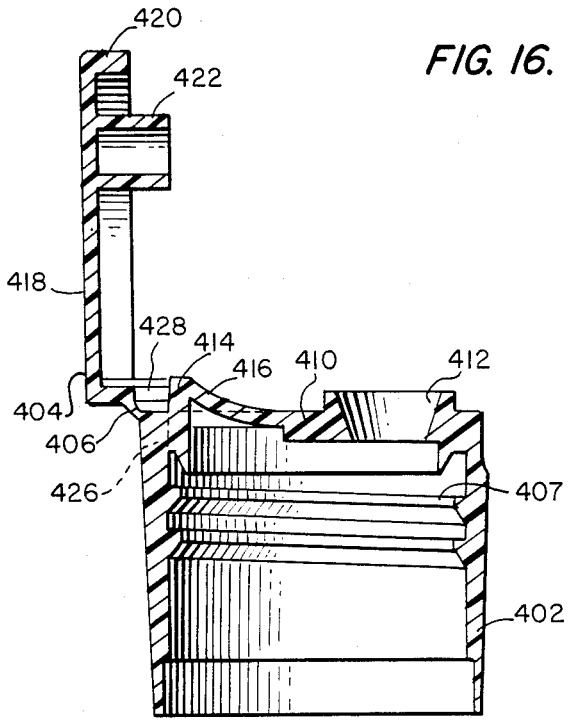
FIG. 16 is a vertical cross-sectional view of the closure of FIGS. 11–15, such view being taken along the line 16—16 in FIG. 12 and in the direction indicated.

Hinge 406 is but a few thousandths of an inch in thickness, and its length and width are but small fractions of an inch. One end of hinge 406 is joined along a pivot line to reinforced holder 426, which is located diametrically opposite to recess 408 and extends vertically about half-way up the thickened wall 414, as shown in FIG. 16. The other end of hinge 406 is joined to lid 404 along pivot line 428.

Figure 18:
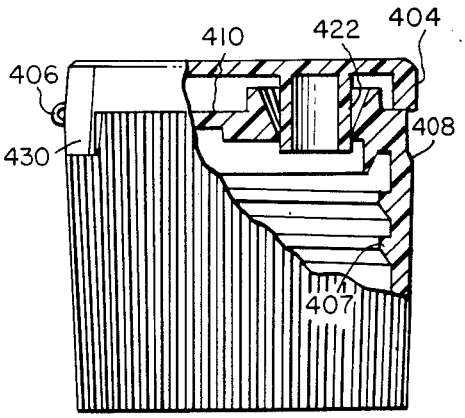
FIG. 18 is a side elevational view, with fragments broken away, showing the closure of FIGS. 11–17 in its closed position.
Figure 19:
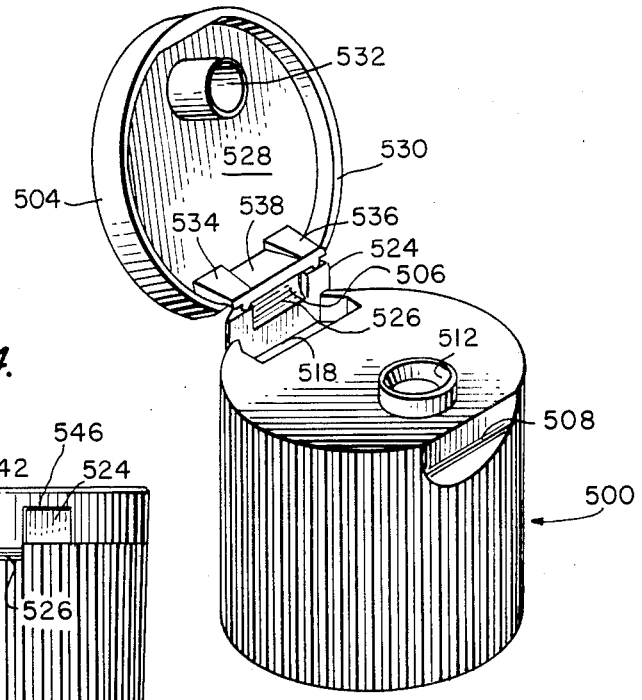
FIG. 19 is a perspective view of an alternative embodiment of a dispensing closure designed in accordance with the principles of the instant invention, such closure being shown in its opened position.
Figure 24:
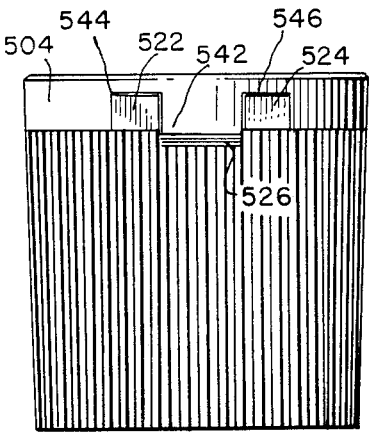
FIG. 24 is a rear elevational view of the dispensing closure of FIGS. 19–23 with the closure shown in its closed position.
Figure 20:
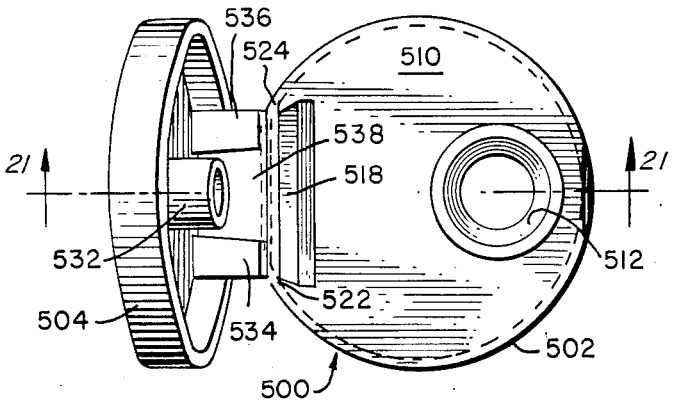
FIG. 20 is a top plan view of the closure of FIG. 19.

A first lug 430 depends below the shallow skirt 420 of lid 404 at one side of hinge 406, and a second lug 432 depends below the shallow skirt at the opposite side of the hinge. A bridge 434 extends between the lugs and reinforces same. In the opened position shown in FIGS. 11, 12, and 16, the lower edges of the lugs 430 and 432 bear against the thickened wall 414. As suggested in FIG. 17, the lugs contact thickened wall 414, and slide therealong, as manual pressure pivots the lid out of its opened position toward its closed position. The lugs exert a resultant force upon the hinge that temporarily deforms same, within its elastic limits, so that the lid 404 moves between its two stable states. After the lid has moved toward its closed position, lid 404 is manually depressed so that plug 422 fits securely into opening 412, as shown in FIG. 18.

Figure 13:
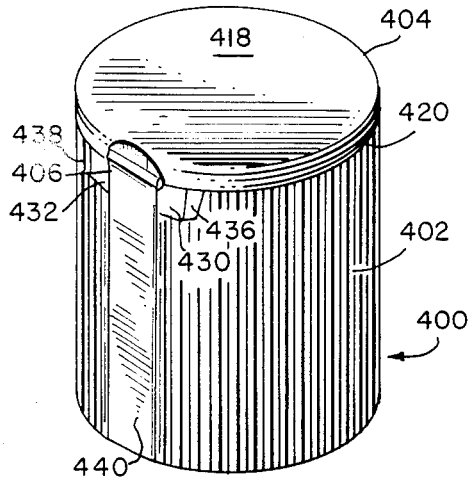
FIG. 13 is a perspective view taken from the rear of the closure of FIG. 11 with the closure being shown in its closed position.
Figure 15:
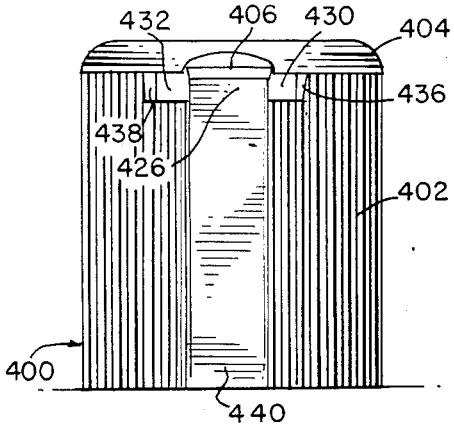
FIG. 15 is a rear elevational view of the closure of FIGS. 11–14 with the closure being shown in its closed position.
Figure 7:
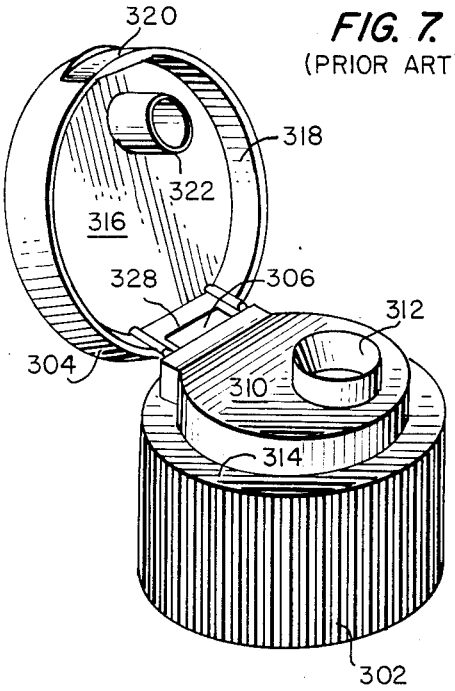
FIG. 7. (PRIOR ART)
FIG. 7 is a perspective view taken from the front of a third conventional dispensing closure, such closure being shown in its opened position.

A first recess 436 is formed at the rear of the closure body 402 adjacent holder 426, and a second recess 438 is formed at the rear of the closure body on the opposite side of holder 426. The recesses have a vertical dimension that is slightly larger than the vertical dimensions of lugs 432, 434, and a radial dimension that is slightly greater than the thicknesses of lugs 432, 434. The portion of reinforced wall 414 extending below top surface 410 defines the innermost extent of the recesses. Thus, when the lid is closed and the plug 422 is seated within opening 412, as shown in FIG. 18, the lugs 432, 434 fit within the recesses and conform to the radial extent of the substantially cylindrical shape of the closure body 402. Bridge 434 fits over the holder 432. These relationships contribute to the pleasing appearance of the closure. The cylindrical shape of the closure body is interrupted only by a flat 440 on its rear surface; the holder 426 is situated atop flat 440, as shown in FIGS. 13 and 15.

DETAILED DESCRIPTION OF AN ALTERNATIVE EMBODIMENT OF THE INVENTION

An alternative embodiment of the unique dispensing closure is shown in FIGS. 19–24, and is identified generally by reference numeral 500. Closure 500 comprises a closure body 502, a lid 504, and a "living" hinge 506 that joins the lid to the body. The body, lid, hinge and other components are integrally molded of a durable, yet resilient plastic, to form a one piece closure.

Figure 21:
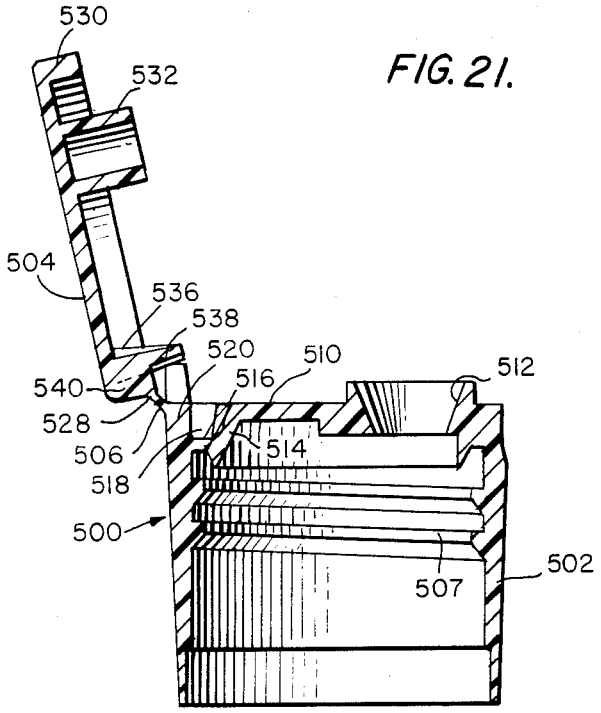
FIG. 21 is a vertical cross-sectional view of the closure of FIGS. 19 and 20, such view being taken along the line 21—21 in FIG. 20 and in the direction indicated.
Figure 22:
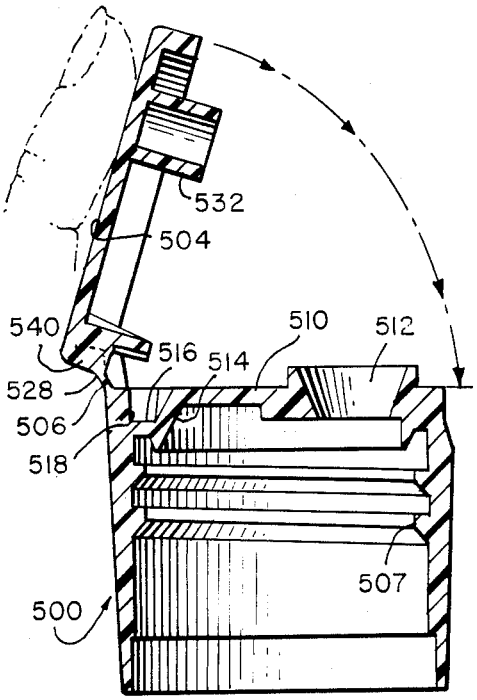
FIG. 22 is a vertical cross-sectional view of the closure of FIGS. 19–21, but indicating the closure being pivoted toward its opened position.
Figure 23:
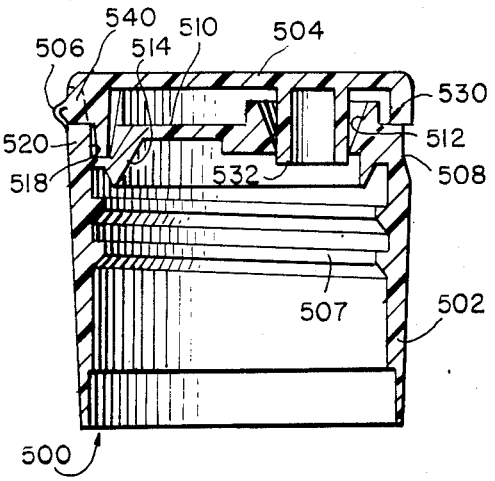
FIG. 23 is a vertical cross-sectional view of the closure of FIGS. 19–22, but showing the closure in its closed position.

Closure body 502 is substantially cylindrical in shape, and has internal threads 507 so that the closure body can be secured to the neck of a container (not shown) which contains the product to be dispensed. An indentation 508 is formed in the front face of the closure, and a top surface 510 extends across the upper end of the closure body. A discharge opening 512 extends through surface 510. A wall segment 514 depends below the level of surface 510, as shown in FIGS. 21–23, and a small horizontal wall 516 extends between wall segment 514 and the rear of closure body 502. Wall segment 514, wall 516, and closure body 502 define a cavity 518. The cavity 518 is wider at its entrance at surface 510 and is narrower at its lower end below surface 510.

A thickened wall 520 is defined between cavity 518 and the rear surface of closure body 502. The wall extends in chord-like fashion across the uper end of the closure body 502. A first post 522 projects upwardly from one side of the wall, and a second post 524 projects upwardly from the opposite side of the wall. Hinge 506 is secured to the wall at pivot line 526 which extends between posts 522 and 524.

Lid 504 comprises a continuous planar top 528 and a shallow annular skirt 530. A sealing plug 532 depends below the skirt. The plug 532 fits into opening 512 to seal the contents of the container to which the closure has been secured when the lid is pivoted toward its closed position, as shown in FIG. 22. The lid is snapped shut by applying pressure to the lid to force the plug 532 to seat completely within opening 512, as shown in FIG. 23.

A first lug 534, and a second lug 536, which are substantially triangular when viewed in side elevation, project downwardly from the underside of the lid. A brace 538 joins the lugs together. The lugs and brace are dimensioned to fit within cavity 518 when the lid is closed.

As shown in FIGS. 21–23, one end of hinge 506 is secured to wall 520 along pivot line 526. A holder 540 is formed at the rear of the skirt 530, and the opposite end of the hinge is secured thereto along pivot line 542. The holder is a thickened member which extends in chord-like fashion across the rear of the lid and properly orients the "living" hinge.

A first recess 544 is defined in the skirt 530 of the lid at one side of holder 540, and a second recess 546 is defined in the skirt at the opposite side of the holder. The recesses are sized, and shaped, to accommodate posts 522, 524 when the lid is pressed into its closed position, as shown in FIGS. 23 and 25. Similarly, in the closed position, lugs 534, 536 and brace 538 fit within cavity 518 depending below surface 510 to contribute to an appealing, low profile dispensing closure.

The outer surfaces of lugs 534, 536 slide along posts 522, 524 and press thereagainst to deform the posts. This interaction enhances the operation of "living" hinge 506, as the lid is pivoted from its opened position toward its closed position, as shown in FIGS. 21–22.

Numerous other revisions, modifications, and changes will occur to the skilled artisan in the closure technology. For example, the reinforced wall 414 may be formed at right angles to the top surface of the closure, or may be canted slightly at a few degrees less than 90 degrees. Consequently, the following claims should not be limited to their literal terms, but should be constructed in a fashion commensurate with their contribution to the useful arts and sciences to which the invention appertains.

What is claimed is:

1. An integrally molded, unitary, plastic dispensing closure comprising:

(a) a closure body of substantially cylindrical shape adapted to be secured to a container,
  (I) said closure body comprising a top surface extending across one end of said closure body,
  (II) said top surface having a dispensing opening extending therethrough,
  (III) a wall segment sloping downwardly below said top surface and a wall extending parallel to said top surface,
  (IV) said wall segment and said wall extending parallel to said top surface defining a cavity extending below said top surface,
  (V) a first post and a second post projecting upwardly from said top surface at points remote from said dispensing opening, (b) a lid,
  (I) said lid comprising an unbroken, continuous planar top and a shallow annular skirt,
  (II) a plug depending below said planar top,
  (III) a first lug and a second lug depending from said planar top and extending below said annular skirt,
  (IV) said lugs contacting said posts when said lid is in its opened position,
  (V) a holder located below said planar top and between said first and second lugs,
  (VI) said skirt having at least one recess defined at one side of said holder, said skirt also having at least one recess defined at the opposite side of said holder, (c) a thin flexible hinge,
  (I) said hinge being joined to said holder on the skirt of said lid along a first pivot line,
  (II) said hinge being joined to said closure body along a second pivot line,
  (III) said hinge urging said lid to a stable position, (d) said lid being pivoted between opened and closed positions while the lugs function as cams to facilitate the temporary deformation of said hinge while passing between its opened and closed positions, (e) said sealing plug being seated within said discharge opening when said lid is in its closed position, (f) said lugs on said lid fitting into said cavity in said top surface, and (g) said posts fitting into recesses on said annular skirt of said lid so that said skirt contacts the upper surface of said closure body.

2. A dispensing closure as recited in claim 1 wherein a brace on said skirt joins said lugs together, said brace also fitting within said cavity when the lid is in its closed position.

3. A dispensing closure as recited in claim 1 wherein said lugs are triangular when viewed in side elevation.

4. A dispensing closure as recited in claim 1 wherein a thickened wall is formed at the rear of said closure body and said posts are located atop said thickened wall, said wall extending in chord-like fashion across said closure body.

5. An integrally molded, unitary, plastic dispensing closure comprising:

(a) a body of substantially cylindrical shape adapted to be secured to a container,
  (I) said closure body comprising a top surface extending across one end of the closure body,
  (II) said top surface having a dispensing opening extending therethrough,
  (III) a reinforced, rigid wall extending upwardly above said top surface of the closure body and situated at a distance from said dispensing opening,
  (IV) a holder located below said top surface and adjacent to said rigid wall,
  (V) said cylindrical body having a first recess defined therein at one side of said holder and a second recess defined therein at the other side of said holder, (b) a lid,
  (I) said lid comprising an unbroken, continuous planar top and a shallow annular skirt,
  (II) a plug depending below said planar top,
  (III) a first lug and a second lug projecting from said planar top at locations remote from said plug, and adjacent to said holder,
  (IV) a bridge extending between said lugs, said bridge being approximately equal in height to said skirt,
  (V) the lower ends of said lugs contacting said rigid wall when said lid is in its opened position, and sliding therealong as said lid is moved between its opened and closed positions, (c) a thin flexible hinge,
  (I) said hinge being joined to said holder on said cylindrical body along a first pivot line, (II) said hinge being joined to said skirt along a second pivot line situated between said first and said second lugs, said hinge urging said lid to a stable position, (d) said lid being pivoted between opened and closed positions while said lugs function as cams to temporarily deform said hinge while said lid pivots between its opened and closed positions, (e) said sealing plug being seated within said discharge opening and said bridge spanning said holder when said lid is in its closed position, the invention being characterized in that:

said lugs depend a significant distance below said annular skirt, said recesses extending downwardly below the level of said top surface of said closure body, and said recesses are configured to accept said lugs completely therewithin when said lid is in its closed position.

6. A dispensing closure as recited in claim 5 further characterized in that said rigid wall extends below said top surface of said closure body and defines one wall of each recess.

* * * * *